US007317157B2

(12) United States Patent
Cslovjecsek

(10) Patent No.: US 7,317,157 B2
(45) Date of Patent: Jan. 8, 2008

(54) MUSICAL INSTRUMENT HAVING A RIBBED SURFACE

(75) Inventor: Markus Cslovjecsek, Niederwil (CH)

(73) Assignee: CSTOOLS GmbH, Niederwil (CH)

( * ) Notice: Subject to any disclaimer, the term of this patent is extended or adjusted under 35 U.S.C. 154(b) by 0 days.

(21) Appl. No.: 10/501,879

(22) PCT Filed: Jan. 21, 2003

(86) PCT No.: PCT/CH03/00042

§ 371 (c)(1),
(2), (4) Date: Jul. 20, 2004

(87) PCT Pub. No.: WO03/060873

PCT Pub. Date: Jul. 24, 2003

(65) Prior Publication Data

US 2005/0028666 A1 Feb. 10, 2005

(30) Foreign Application Priority Data

Jan. 21, 2002 (CH) ..... 0094/02

(51) Int. Cl.
*G10D 13/08* (2006.01)

(52) U.S. Cl. ..... 84/410

(58) Field of Classification Search ..... 84/410, 84/402, 408, 409

See application file for complete search history.

(56) References Cited

U.S. PATENT DOCUMENTS 1,987,232 A * 1/1935 Gilbert ..... 68/228
4,480,521 A * 11/1984 Schmoyer ..... 84/715
6,066,025 A * 5/2000 Wisniewski ..... 446/410
6,512,169 B1 * 1/2003 Santini ..... 84/402

FOREIGN PATENT DOCUMENTS

| | | |
|---|---|---|
| DE | 38 42 311 | 7/1989 |
| DE | G91 14 404.3 | 3/1992 |
| WO | WO 01 32989 | 5/2001 |

OTHER PUBLICATIONS

Making Simple Musicla Instruments , 1995 Lark Books pp. 42-43, Hopkin, Bart.*
Making Simple Musicla Instruments , 1995 Lark Books pp. 16 and 42-43, Hopkin, Bart.*
International Search Report for PCT/CH03/00042 of Jun. 5, 2003 (English).

* cited by examiner

*Primary Examiner*—Kimberly Lockett
(74) *Attorney, Agent, or Firm*—Joyce von Natzmer; Pequignot + Myers LLC

(57) ABSTRACT

The invention relates to a musical instrument with which a sound is produced in the same manner as when playing the guiro (Latin American percussion instrument: longish gourd having a regularly notched surface) by scratching with the finger nail or by playing with a playing aid. In contrast to the guiro or also to the percussion instrument called a wash-board, sound rows can be made of individual modules or sections. Playing in a constant tempo enables the production of analogous rhythms due to the constructed interval ratios and scales can be produced by combining different frequencies. Particular embodiments of the instrument and of the playing aid made of different materials produce many nuances in sound that challenge the creativity and the curiosity of the player even more. Possible materials include wood, paperboard, plastic, rubber, metal, ceramics and stone.

21 Claims, 2 Drawing Sheets

MUSICAL INSTRUMENT HAVING A RIBBED SURFACE

This application is the national stage of International application PCT/CH03/00042, filed Jan. 21, 2003. designating the U.S., whose contents is incorporated herein by reference in its entirety.

BACKGROUND OF THE INVENTION

Musical instruments produce sound waves by means of vibration and reinforce them via a resonator. Sound waves are triggered by vibrating strings, air columns, diaphragms or plates. Ribbings, as a further possibility for producing sound are used, in particular, in the case of sound instruments.

By definition, a musical instrument is an implement for producing notes and sounds, in order to make music. It is distinguished by the fact that at least one player actively operates it and thereby creates music.

Sounds can be stored mechanically, magnetically or optically in the form of prepared surfaces and can be reproduced. The possibilities of producing sounds by means of prepared surfaces are also known in road building (Pat. A1 WO 01/32989 and others). However, these applications do not involve a musical instrument in the actual sense, but rather a type of sound-recording medium which, similar to a record, is played by moving over it. In these cases, no creative activity by the consumer is expected.

SUMMARY OF THE INVENTION

The invention pertains to a musical instrument, in particular for musical creation and instruction, characterized in that at least part of the surface has a regular or an irregular structure (FIG. 2). The ribbings of the musical instrument can differ in design, in particular (FIG. 4) wavy, rectangle, triangle. The wavelengths of the ribbing can be between 0.001 mm and 250 mm, in particular 1 to 12 mm, specifically 3, 6 or 12 mm. In one embodiment, the musical instrument is cut to the desired length from a roll by the user. The instrument can be provided with a graduation or a predetermined breaking point for the precise cutting into lengths. The musical instrument may be fixed by means of its configuration on an appropriate base in a rail, a mount or by means of an adhesive device. Each different frequency of the musical instrument may be identified by a different color. The musical instrument can be constructed from modules (FIG. 5) which may be combined.

The invention is further directed to a module for the above musical instrument having a coupling on two opposite sides A and B enabling the module to be connected rigidly to other modules. The coupling may be constructed in such a manner that the individual modules can be connected both to opposite sides A-B and also to the sides A-A (FIGS. 5 and 6). In a preferred embodiment, the surface of the module takes one of the following configurations:

(a) the entire surface of said module is ribbed, or (b) ½ of the surface of said module is ribbed and the other half is flat, or (c) the surface of the module is alternately ¼ ribbed, ¼ flat, ¼ ribbed, and again ¼ flat, or (d) ¼ of the surface of the module is ribbed and ¾ are flat, or (e) ¾ of the surface of the module are ribbed and ¼ is flat, or (f) ¼ of the surface of the module is ribbed, ¼ is flat and the rest is ribbed, or (g) ¼ of the surface of the module is flat, ¼ is ribbed and the rest is flat, or (h) ¼ of the surface of the module is ribbed, ½ is flat and the rest is ribbed, or (i) ¼ of the surface of the module is flat, ½ is ribbed and the rest is flat, or (j) the entire surface of the module is flat, or (k) there are individual ribs in the flat module.

(FIGS. 3*a-k*)

The module may contain a guide (1) transversely to the ribbing for stabilizing a device for holding a playing aid. The guide also permits curves and branches. The module may also have four sides A, B, C, D, characterized in that there is a coupling on all of the sides A, B, C and D enabling the module to be connected rigidly in any desired direction to other modules.

VARIOUS AND PREFERRED EMBODIMENTS

In the case of the musical instrument according to the present invention, a sound is produced in the same manner as when playing the "Guiro" (FIG. 1), a Latin American rhythm instrument comprising a longish gourd having a regularly notched surface, by scratching it with the fingernail or playing it with a playing aid. In contrast to the "Guiro" or else to the percussion instrument "skiffle board", in the case of the musical instrument according to the invention, relative sounds can be built up from individual modules or sections. Musical instruments therefore also differ from sound-recording media, such as the record or road grooves which can be moved over, which are based on the same principle as producing sound, in precisely the same manner as an electric piano differs from a radio. The transverse grooves on the carriageway produce sounds, notes and sequences of notes in interaction with the tires of vehicles traveling over them. However, the recipient, as in the case of the radio set, can only have an effect on the creation to a very limited extent: drive over it versus not drive over it or switch on versus switch off. For this reason, the use of the corresponding sound production principle on public roads does not involve a musical instrument in the actual sense.

Playing the musical instrument according to the invention at a constant tempo makes it possible to produce analogous rhythms, on account of the interval ratios which are present, and also sequences of notes, by combining different frequencies. The playing and combining of excerpts of created rows of sounds and the combination with different musical instruments makes musical composition techniques, such as sampling, pattern technique and Minimal Art come alive. As a result, in addition to the playing and entertainment value, the instrument has a high pedagogical value. In contrast to the use on roads, the combination of modules is creatively designed and changed by the players themselves.

Particular embodiments of the instrument and of the playing aid in different materials produce many nuances in sound which additionally challenge the creativity and curiosity of the player. Possible materials are: wood, cardboard, plastic, metal, ceramic, stone. A further embodiment of the invention constitutes the virtual realization on a viewing screen. The instrument can then be sold on CD or can be accessible on the Net.

BRIEF DESCRIPTION OF THE DRAWINGS

Figure 1:
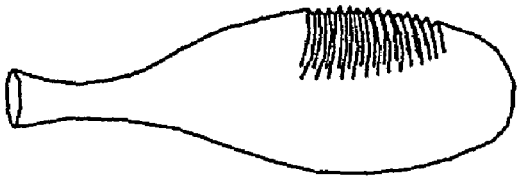
FIG. 1 shows a Guiro.

FIG. 1 shows a Guiro.

Figure 2:
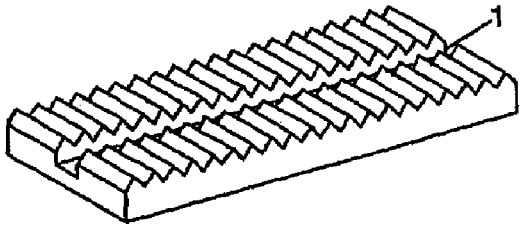
FIG. 2 shows an instrument for scratching.
Figure 3:
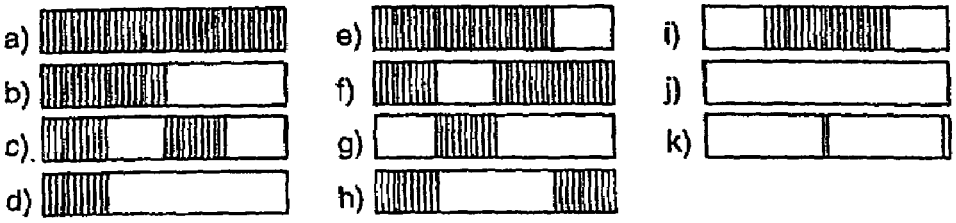
FIG. 3 a to k show individual modules according to the present invention.

FIG. 2 shows an instrument for scratching.

FIG. 3*a* to *k* show individual modules according to the present invention.

Figure 4:
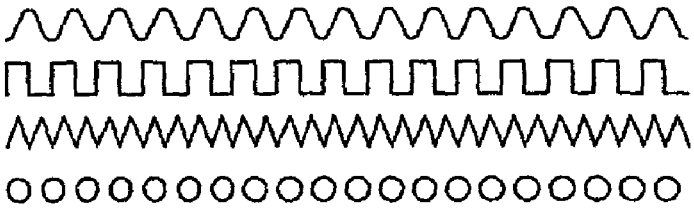
FIG. 4 shows a ribbing according to the present invention.

FIG. 4 shows a ribbing according to the present invention.

Figure 5:
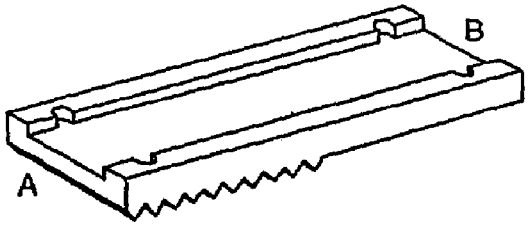
FIG. 5 shows a module according to the present invention.

FIG. 5 shows a module according to the present invention.

Figure 6:
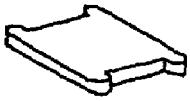
FIG. 6 depicts a coupling piece.

FIG. 6 depicts a coupling piece.

Figure 7:
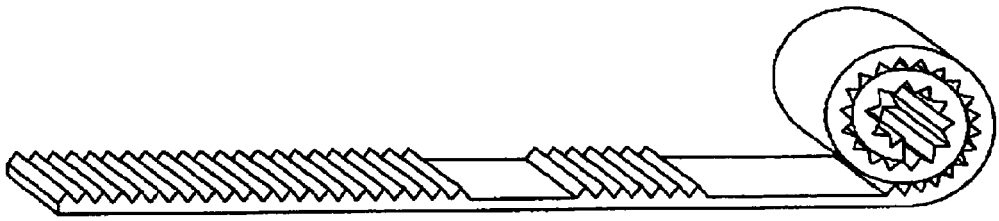

FIG. 7 shows a roll comprising at least one musical instrument.

Figure 8:
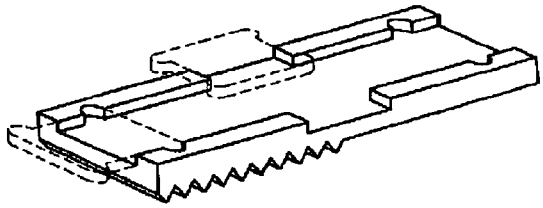

FIG. 8 shows a module with a coupling on each of its four sides.

The musical instrument comprises sections or modules having a regularly ribbed or studded surface. These ribbings may differ in design (FIG. 4), since their shape is not crucial for the sound. A critical factor for the frequency which arises at a constant tempo x is the wavelength of the ribbing.

Rhythmic rows of sounds can be built up from individual sections and spaces or from combinations of the modules. If a plurality of wavelengths are used, melodically rhythmic rows of sounds are produced in combined form. The instrument is designed in various forms:

(1) As a band or strip of cardboard or plastic, so that it can be cut to a desired length, for example, from the roll by the user himself. The different frequencies may be identified by a different color in each case. For easier fixing on a base, the band may be equipped with an adhesive device and, as an orientation aid for cutting it into lengths, may be provided with a graduation.

(2) As modules having different ratios of ribbed and unribbed surface (FIGS. 3*a-k*). These modules can be connected rigidly to a coupling, specifically in such a manner that the modules can be connected both to opposite sides and also to the same sides. The modules may be formed from wood, cardboard, metal, plastic, rubber, ceramic or stone. The connection may be designed, for example, as an asymmetric plug-in coupling, snap fastener or magnetic coupling or may be realized with an additional coupling piece (FIGS. 5-6).

(3) As modules of identical size with ribbed surfaces in different frequencies or frequency variations. These modules may be connected to one another longitudinally and/or laterally. Rows of sounds or entire areas may be built up with them.

(4) As modules with a square cross section and longitudinal sides with different ribbings. By fixing them in a rail, new musical results can be obtained by simple rotation and displacement of individual modules.

The rows of sounds which are formed from different sections or modules may be played with the fingernail, but also with a playing aid. This playing aid is a pencil, a resilient pointer, a slider or a roller of wood (e.g. an ice lolly stick), plastic (e.g. a credit card), metal (e.g. a teaspoon), horn or cardboard which snaps into the ribbing in a rapid sequence corresponding to the playing tempo and thereby produces the sound. The playing aid can be moved over the row of sounds held in the hand or else clamped into a slide or carriage. A different sound is produced depending on the material, size, shape and manner of fixing the playing aid. The dimensions of the modules, in particular the width thereof, do not have any decisive effect on the phenomenon on which the invention is based. Solutions which are played by means of skateboards, pushchairs etc., are therefore also conceivable.

In a software variant, the geometrical features are expressed pictorially. The surface of the instrument has virtual ribbing, with it being possible for the virtual ribbing to be illustrated by different coloring of the high and low regions of the ribbing, or more precisely, different coloring of the ribbed and of the flat regions. In side view, the ribbings may, of course, also be illustrated geometrically, but do not have to be. The underside of the modules is then stuck on a virtual table or a virtual resonator. The individual modules may be cut to length, for example with the aid of the computer mouse, scissors or a knife, with it being possible for the grid of the graduation to be configured in such a manner that cutting can only take place along the grid lines. In exactly the same way as in the hardware version, the different frequencies are emphasized by different coloring. Opposite sides A and B have a matching, mirror-inverted coupling. The realization of a magnetic coupling then means that the modules are attracted towards one another in a manner suitable for their poles as soon as they have been pushed sufficiently close toward one another with the mouse. It is possible to influence the sound by means of different playing aids and different bases.

It is also conceivable that the computer can be used to place one's own sound samples (via a microphone or line input) or samples from data files onto the modules. There is then, firstly, the possibility of placing a sound onto the entire set of modules, but also the variant that an entire song is loaded onto a long, ribbed strip which then, cut into sections, can be combined in new ways.

The invention claimed is:

1. A musical instrument comprising a surface, wherein:

at least part of said surface comprises a ribbing, wavelengths of said ribbing are between 0.001 mm and 250 mm, a certain wavelength results in a certain frequency when said instrument is played at a constant tempo, and individual modules or sections of said surface provide for the built-up of relative sounds, wherein said individual modules are combinable to a combination of modules and for a player to change the combination of modules.

2. The musical instrument of claim 1, wherein said ribbing is wavy, rectangular, triangular or a combination thereof.

3. The musical instrument of claim 1, wherein said wavelengths are between 1 mm and 12 mm.

4. The musical instrument of claim 1, wherein said wavelengths are 3, 6 or 12 mm.

5. A method of producing the musical instrument of claim 1, wherein the musical instrument is cut from a roll to a desired length.

6. A roll comprising the musical instrument of claim 1, wherein the roll is provided with at least one graduation or predetermined breaking point to produce a musical instrument of the desired length.

7. The musical instrument of claim 1, wherein said instrument can be fixed by means of its configuration onto an appropriate base in a rail, a mount or by means of an adhesive device.

8. The musical instrument of claim 1, wherein said instrument has different frequencies that are identified by different colors.

9. A module for a musical instrument having a surface, wherein at least part of the surface of the module comprises a ribbing, wherein wavelengths of said ribbing are between 0.001 mm and 250 mm, and said module comprises two opposite sides A and B and a coupling on each of said opposite sides, wherein:

said module can be rigidly connected via said couplings to one or more further modules comprising surfaces, at least part of said surfaces of said further modules are flat or ribbed, and the surfaces of individual modules provide for the built-up of relative sounds and wherein said individual modules are combinable to a combination of modules and for a player to change the combination of modules.

10. The module of claim 9, wherein said module can be connected to opposite sites A or B of said one or more further module via either site A or B of said module.

11. A module for a musical instrument having a surface, wherein at least part of the surface of the module comprises a ribbing, wherein wavelengths of said ribbing are between 0.001 mm and 250 mm, and said module comprises two opposite sides A and B and a coupling on each of said opposite sides, wherein said module can be rigidly connected via said couplings to one or more further modules comprising surfaces, wherein at least part of said surfaces of said further modules are flat or ribbed, and wherein (a) the entire surface of said module is ribbed, (b) ½ of the surface of said module is ribbed and the other half is flat, (c) the surface of the module is alternately ¼ ribbed, ¼ flat, ¼ ribbed, and ¼ flat;

(d) ¼ of the surface of the module is ribbed and ¾ are flat, (e) ¾ of the surface of the module are ribbed and ¼ is flat, (f) ¼ of the surface of the module is ribbed, ¼ is flat and the rest is ribbed, (g) ¼ of the surface of the module is flat, ¼ is ribbed and the rest is flat, (h) ¼ of the surface of the module is ribbed, ½ is flat and the rest is ribbed, (i) ¼ of the surface of the module is flat, ½ is ribbed and the rest is flat, or (j) there are individual ribs on the surface of the otherwise flat module.

12. The module of claim 9 comprising a guide for stabilizing a device for holding a playing aid, wherein said guide is oriented transversely to a ribbing on the surface of the module.

13. The module of claim 12, wherein the guide also permits curves and branches.

14. The module of claim 9 comprising two additional sides C and D and a coupling on each of said sides C and D, wherein the module can be rigidly connected in any desired direction to another module via said couplings.

15. The musical instrument of claim 1, wherein said instrument is configured for it to be fixed onto an appropriate base in a rail, a mount or by means of an adhesive device.

16. The instrument of claim 1, wherein said musical instrument is virtually implemented for viewing on a screen of a computer.

17. A module for a musical instrument comprising a surface, wherein at least part of the surface of the module comprises a ribbing, wherein wavelengths of said ribbing are between 0.001 mm and 250 mm, and said module comprising at least two opposite sides A and B and a connection on each of said opposite sides A and B for rigidly connecting via said connection said module to one or more further modules comprising surfaces, wherein at least part of said surfaces of the further modules are flat or ribbed, wherein the surfaces of individual modules provide for the built-up of relative sounds, and wherein said individual modules are combinable to a combination of modules and for a player to change the combination of modules.

18. A module for a musical instrument comprising a surface, wherein at least part of the surface of the module comprises a ribbing, wherein wavelengths of said ribbing are between 0.001 mm and 250 mm, and said module comprising at least two opposite sites A and B and a connection on each of said opposite sites A and B for rigidly connecting via said connection said module to one or more further modules comprising surfaces, wherein at least part of said surfaces of the further modules are flat or ribbed, and wherein (a) the entire surface of said module is ribbed, (b) ½ of the surface of said module is ribbed and the other half is flat, (c) the surface of the module is alternately ¼ ribbed, ¼ flat, ¼ ribbed, and ¼ flat;

(d) ¼ of the surface of the module is ribbed and ¾ are flat, (e) ¾ of the surface of the module are ribbed and ¼ is flat, (f) ¼ of the surface of the module is ribbed, ¼ is flat and the rest is ribbed, (g) ¼ of the surface of the module is flat, ¼ is ribbed and the rest is flat, (h) ¼ of the surface of the module is ribbed, ½ is flat and the rest is ribbed, (i) ¼ of the surface of the module is flat, ½ is ribbed and the rest is flat, or (j) there are individual ribs on the surface of the othewise flat module.

19. The module of claim 17 comprising a guide for stabilizing a device for holding a playing aid, wherein said guide is oriented transversely to a ribbing on the surface of the module.

20. The module of claim 17 comprising two additional sides C and D and a connection on each of said sides C and D for rigidly connecting said modules to another module.

21. A musical instrument comprising a surface, wherein:

at least part of said surface comprises a ribbing, wavelengths of said ribbing are between 0.001 mm and 250 mm, a certain wavelength results in a certain frequency when said instrument is played at a constant tempo, and individual modules or sections of said surface provide for the built-up of relative sounds, wherein said individual modules comprise surfaces, wherein at least part of said surfaces are flat or ribbed, and wherein (a) the entire surface of said module is ribbed, (b) ½ of the surface of said module is ribbed and the other half is flat, (c) the surface of the module is alternately ¼ ribbed, ¼ flat, ¼ ribbed, and ¼ flat;

(d) ¼ of the surface of the module is ribbed and ¾ are flat, (e) ¾ of the surface of the module are ribbed and ¼ is flat, (f) ¼ of the surface of the module is ribbed, ¼ is flat and the rest is ribbed, (g) ¼ of the surface of the module is flat, ¼ is ribbed and the rest is flat, (h) ¼ of the surface of the module is ribbed, ½ is flat and the rest is ribbed, (i) ¼ of the surface of the module is flat, ½ is ribbed and the rest is flat, or (j) there are individual ribs on the surface of the otherwise flat module.

* * * * *